United States Patent [19]

Bakermans

[11] Patent Number: 4,995,289

[45] Date of Patent: Feb. 26, 1991

[54] DIE ASSEMBLY HAVING IMPROVED INSERT RETAINING SYSTEM AND HAVING REVERSIBLE DIE INSERTS

[75] Inventor: Johannes C. W. Bakermans, Harrisburg, Pa.

[73] Assignee: AMP Incorporated, Harrisburg, Pa.

[21] Appl. No.: 376,485

[22] Filed: Jul. 7, 1989

[51] Int. Cl.[5] ..... B26F 1/14

[52] U.S. Cl. ..... 83/690; 83/691; 83/698; 83/955

[58] Field of Search ..... 83/690, 691, 698, 955

[56] References Cited

U.S. PATENT DOCUMENTS

| | | | |
|---|---|---|---|
| 2,502,072 | 3/1950 | Bender | 83/690 |
| 3,392,617 | 7/1968 | Henn | 83/691 |
| 3,613,491 | 10/1971 | Kahmann | 83/690 |
| 3,805,659 | 4/1974 | Fisher, Jr. | 83/690 |
| 4,819,476 | 4/1989 | Bakermans et al. | 72/456 |
| 4,821,556 | 4/1989 | Bakermans et al. | 72/420 |

*Primary Examiner*—Hien H. Phan

[57] ABSTRACT

Die assembly comprises a die plate having one or more die inserts therein. The die plate has a recess within which the insert is positioned. The die opening in the insert extends normally of the oppositely directed major surfaces of the insert so that the insert can be reversed. The original obverse surface of the insert thus becomes the reverse surface and the original reverse surface becomes the obverse surface. The necessity of sharpening the die insert in the conventional manner is thus eliminated. Also disclosed is an improved system for mounting die inserts in a die assembly.

13 Claims, 6 Drawing Sheets

DIE ASSEMBLY HAVING IMPROVED INSERT RETAINING SYSTEM AND HAVING REVERSIBLE DIE INSERTS

FIELD OF THE INVENTION

This invention relates to die assemblies of the type used in a punch and die set for punching holes in strip metal and particularly to a die assembly having an improved die insert which can be reversed in the die plate thereby to double the effective life of the insert. The invention also relates to an improved method of manufacturing die inserts and to an improved system for mounting die inserts in a die assembly.

CROSS REFERENCES

U.S. Pat. Nos. 4,497,196, 4,819,476, and 4,809,576 are hereby incorporated into this application by reference.

BACKGROUND OF THE INVENTION

A conventional punch and die set for punching holes in strip metal comprises a die assembly having a facial surface and having a die opening extending into the facial surface. The punch assembly, which is opposed to the die assembly, has a punch projecting therefrom which is dimensioned to enter the die opening so that when strip material is located between the punch and die and the punch and die are moved towards each other, a hole will be formed in the strip by the punch. The slug or scrap metal produced when the hole is formed is pushed by the leading end of the punch into the die opening and removed in any suitable manner.

After a die assembly has been in use for some time, the edges of the die opening at the facial surface of the die assembly become worn and the holes which are produced in the strip metal by the punch and die will not have the dimensional precision which may be required in the part that is being produced. It is therefore common practice to sharpen the die, a process which is carried out by grinding the surface of the die assembly so that the surface material is removed and the dimensional precision of the die opening is restored. A conventional die assembly has a die plate in which many die openings are provided. In order to avoid the necessity of grinding the surface of the die plate, it is common practice to provide die inserts in the die plate which have the die openings therein. The inserts are mounted in a recess in the die plate and held in position by a laterally extending projection on the insert which is received in a die backup block, or spacer, of the die assembly so that when the die plate is secured to the spacer or die backup block, the insert will be securely held in the recess in the die plate. Where die inserts are used, sharpening of a particular insert can be carried out by removing that insert from the die assembly and sharpening only that particular insert. The sharpening process, however, is time consuming and requires the services of a highly skilled machinist for the reason that when the surface of the insert is ground during a sharpening process, the thickness of the insert is thereby reduced and it is necessary to place a suitable shim beneath the insert so that the surface of the insert will be coplanar with the facial surface of the die plate. This means that the laterally extending ear or retaining portion of the insert must also be ground in a precision grinding operation. The advantages of using die inserts are, to some extent at least, nullified by the difficulty of sharpening a die insert.

The present invention is directed to the achievement of an improved die insert by means of which the necessity of sharpening the insert is eliminated and, at the same time, the useful life of the insert is extended. The invention is further directed to the achievement of an improved method of manufacturing die insert and improved methods of mounting die inserts in a die assembly.

THE INVENTION

One embodiment of the invention comprises a die assembly which is intended for use in a punch and die set. The die assembly has a facial surface which is opposed to the punch when the die assembly is installed in a punch and die set. A recess is provided in the facial surface and a die insert is provided in the recess. A die opening extends through the die assembly, the die opening comprising a die insert opening which extends through the insert normally of the facial surface. The die assembly is characterized in that the recess has a recess surface which is parallel to the facial surface. The die insert has an obverse surface and a reverse surface, the reverse surface being against the recess surface and remote from the facial surface and the obverse surface being proximate to, and parallel to, the facial surface. The insert and the recess have abutting insert side surface portions and abutting recess side surface portions, respectively, which are against each other. The abutting insert side surface portions extend between the obverse and reverse surfaces and the abutting recess side surface portions extend from the facial surface to the recess surface. The abutting recess side surface portions and the abutting insert side surface portions are symmetrical with respect to a plane which is parallel to, and is midway between, the obverse and reverse surfaces so that the insert can be reversed in the recess so that the original obverse surface becomes the reverse surface and the original reverse surface becomes the obverse surface.

In the preferred embodiment, the die insert opening has insert opening surface portions which extend normally of the obverse surface and normally of the reverse surface and the dimensions of the die insert opening at the obverse surface are identical to the dimensions of the die insert opening at the reverse surface. The die insert opening is thus straight and is not tapered. The abutting recess side surface portions are in the preferred embodiment extend normally of the facial surface and normally of the recess surface. Similarly, the abutting insert side surface portions extend normally of the obverse and reverse surfaces. Preferably, the insert and the insert opening have at least one axis of symmetry which extends parallel to the obverse and reverse surfaces.

In the preferred embodiment, the die assembly comprises a die plate and retaining plate means, the facial surface being one surface of a die plate and the obverse surface of the insert. The retaining plate means is on the facial surface and is in at least partially surrounding relationship to the insert. The retaining plate means has portions which overlap the recess and the insert thereby to retain the insert in the recess.

A die assembly in accordance with the invention may be characterized in that the insert which is mounted in the die assembly is an in situ insert and a plurality of spare inserts are provided which are identical to the in situ insert whereby the in situ insert can be replaced by one of the spare inserts.

In accordance with a further aspect thereof, the invention comprises a method of making a plurality of die inserts which are intended for use in a die assembly. The die assembly has a facial surface and has a recess in the facial surface which is dimensioned to receive an insert, the insert having an insert opening extending therethrough. The method comprises the steps of providing a block of insert material having a cross-section which conforms to the shape and overall dimensions of an insert and which has a length which is equal to at least the combined thicknesses of a plurality of inserts. In accordance with the method, an opening is formed in the block which extends through the block and normally of the cross-section thereof and the block is thereafter diced along spaced-apart dicing planes which extend parallel to the cross-section and normally of the length of the block thereby to produce the plurality of individual inserts.

THE DRAWING FIGURES

THE DISCLOSED EMBODIMENT

Figure 1:
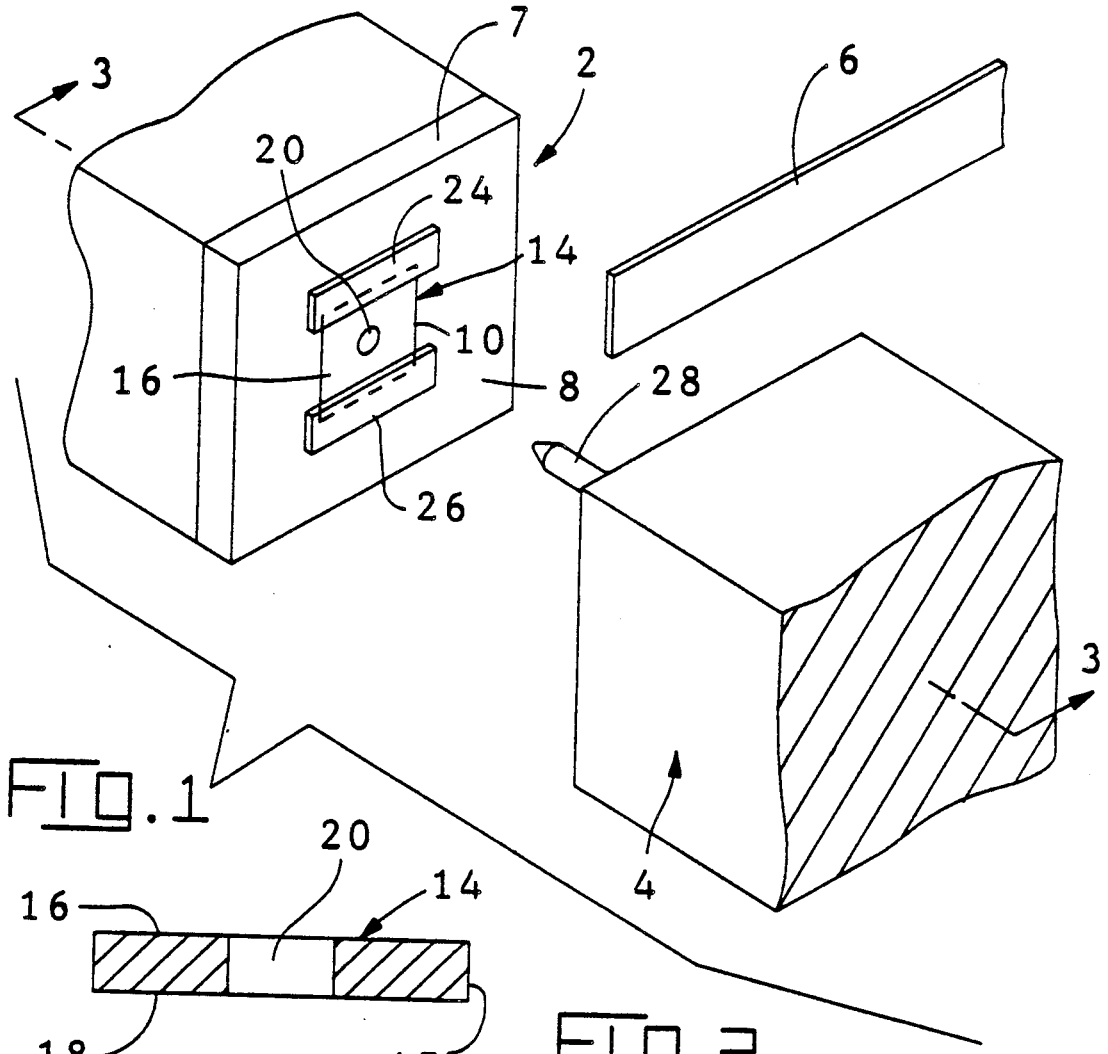
FIG. 1 is a perspective view which shows only the essential features of a punch and die set in accordance with the invention.
Figure 2:
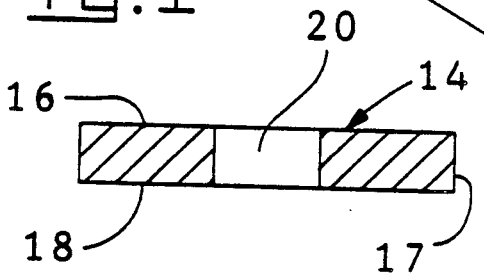
FIG. 2 is a sectional view of a die insert which is mounted in the die assembly shown in FIG. 1.
Figure 3:
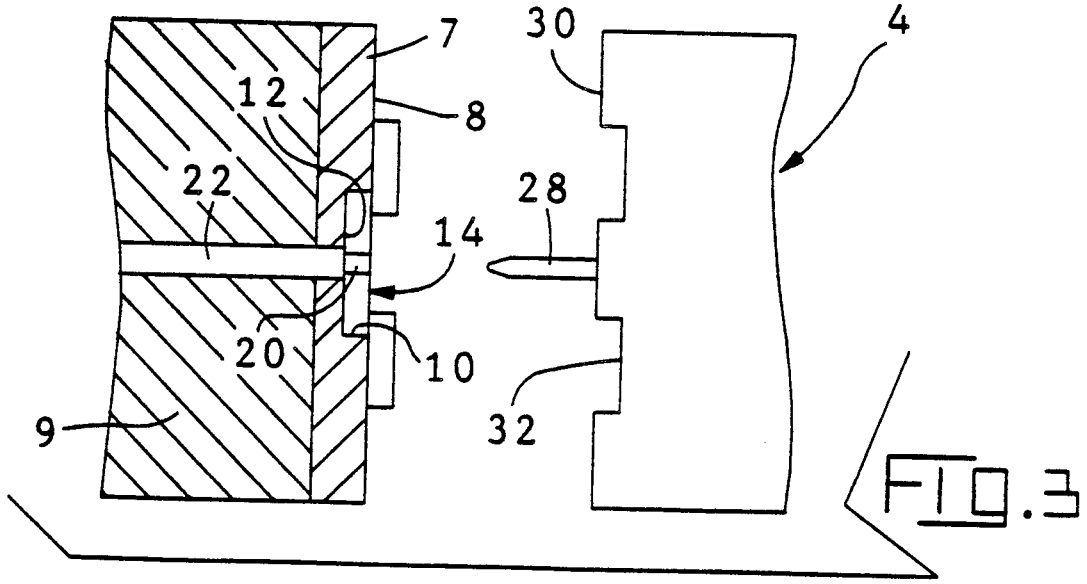
FIG. 3 is a sectional side view looking in the direction of the arrows 3—3 of FIG. 1.
Figure 4:
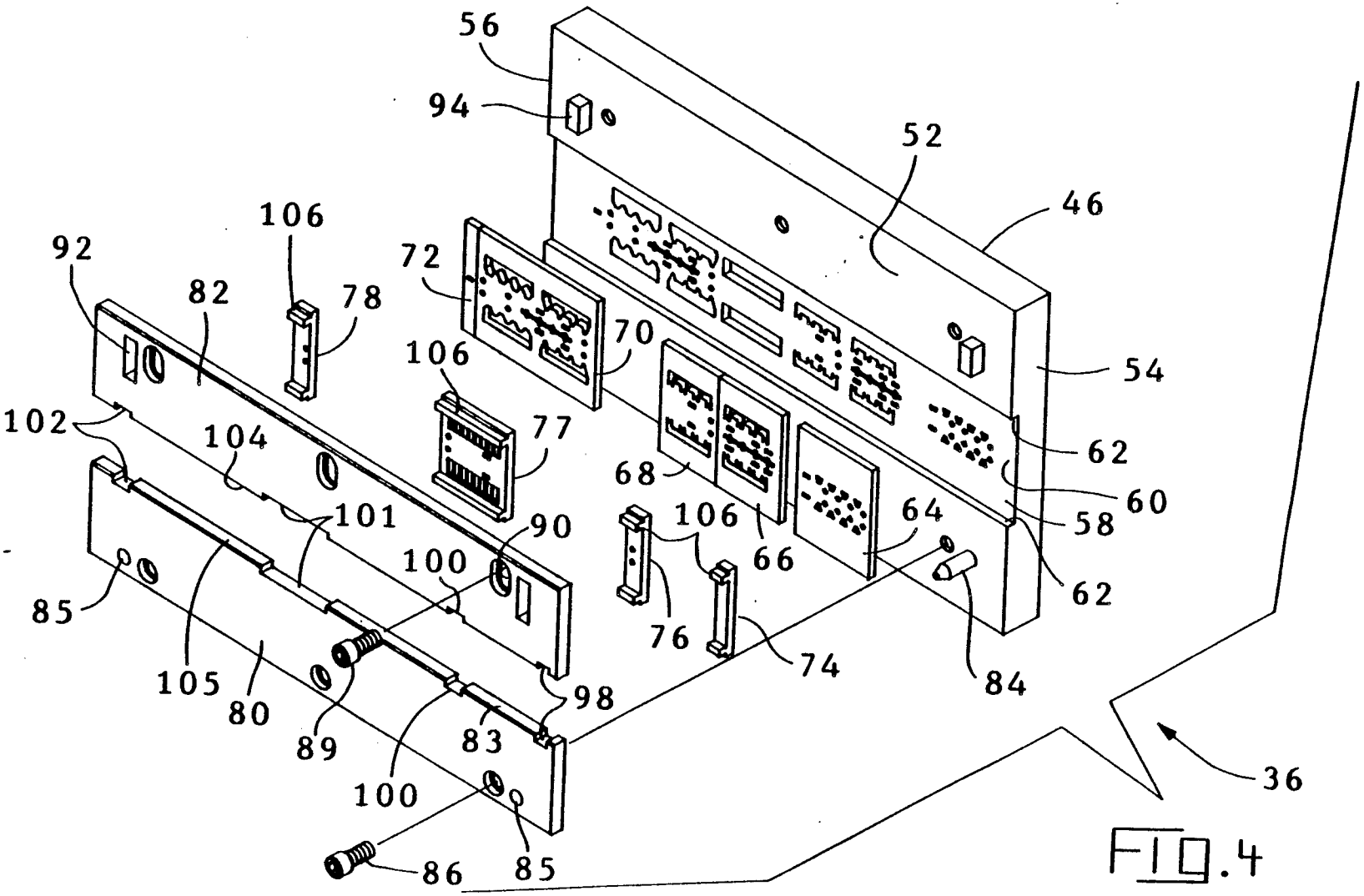
FIG. 4 is a perspective exploded view of portions of a die assembly in accordance with the invention.
Figure 5:
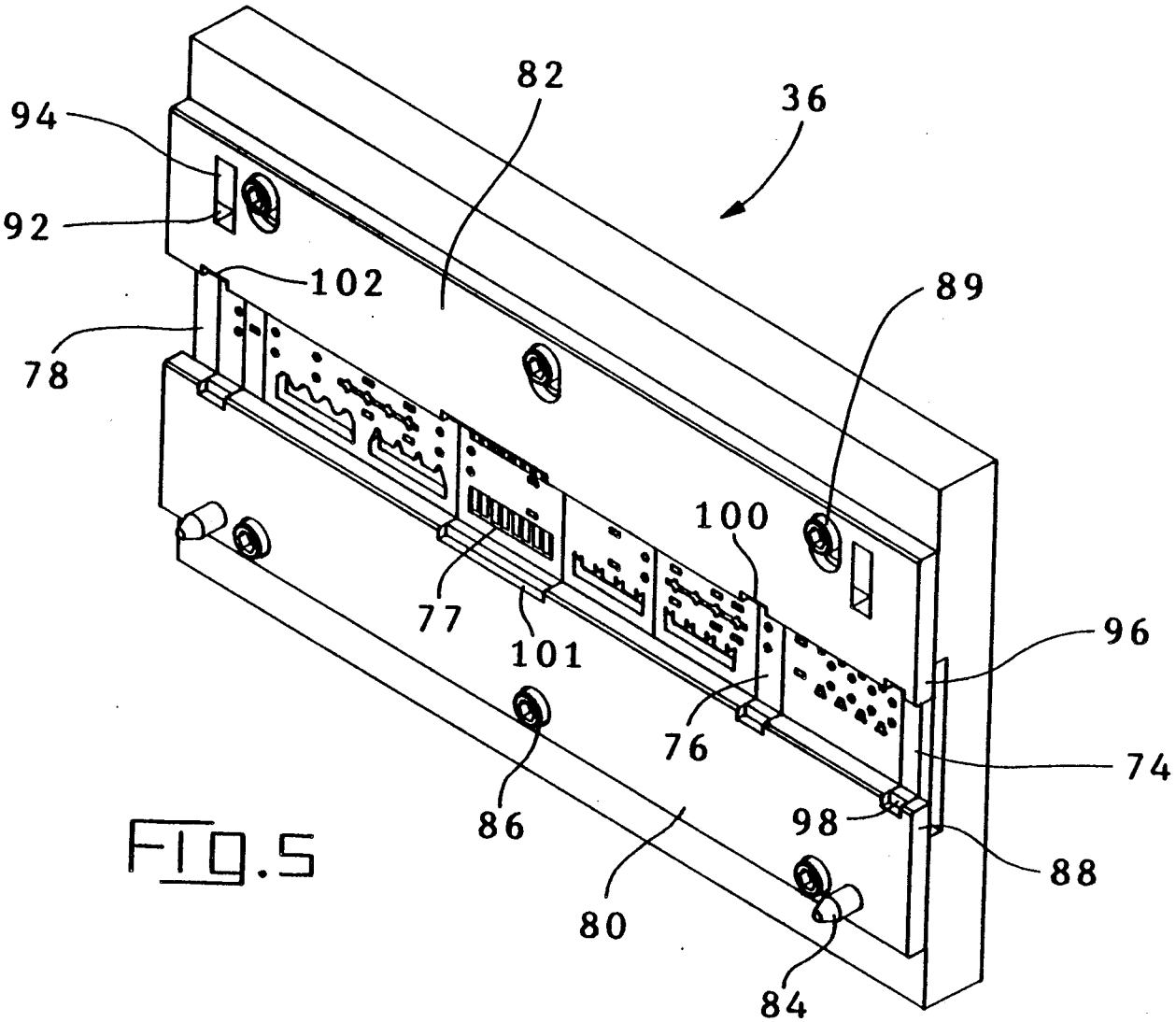
FIG. 5 is a view similar to FIG. 4 showing the parts in their assembled positions.
Figure 6:
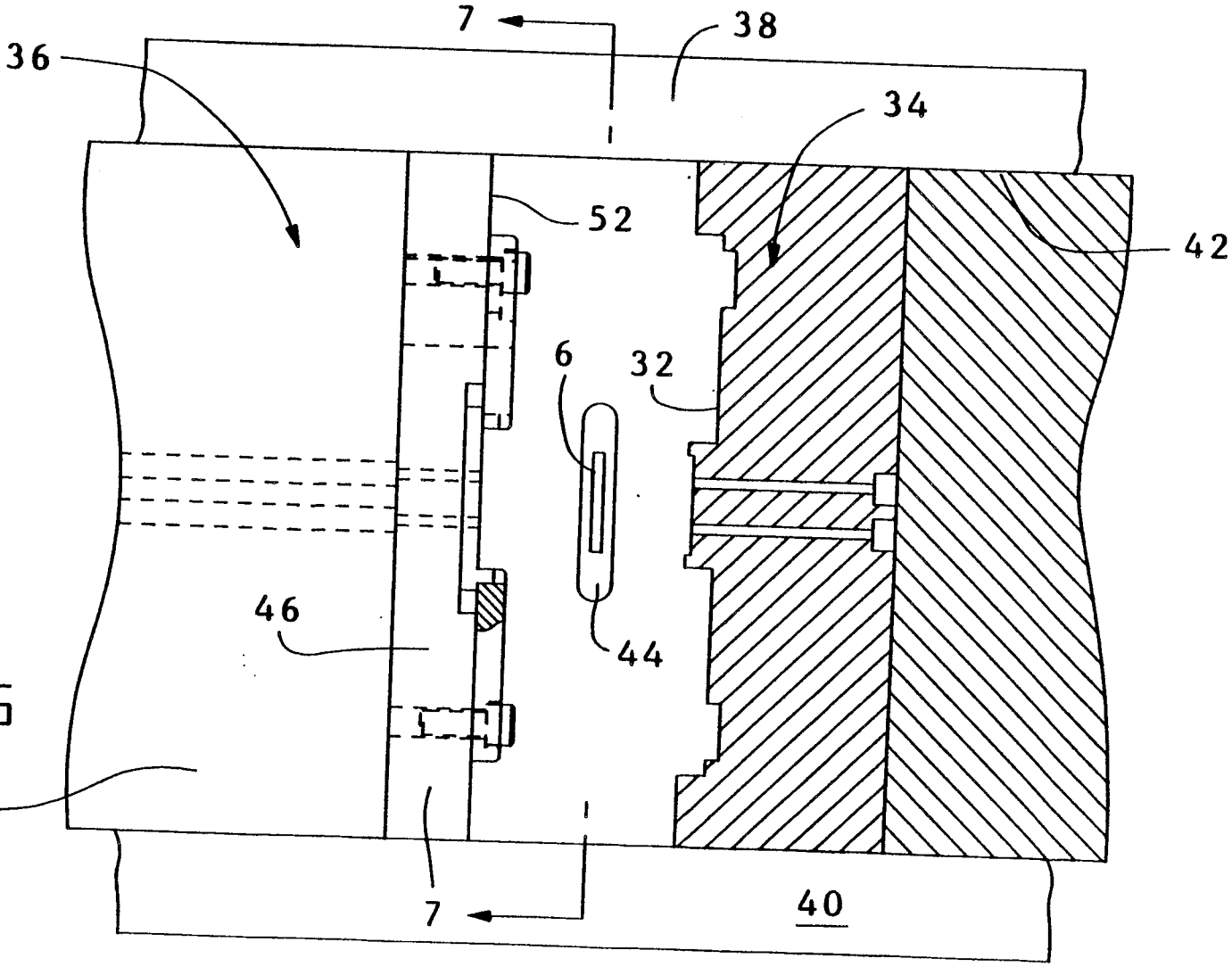
FIG. 6 is a side view showing a punch assembly and the die assembly of FIGS. 4 and 5.
Figure 7:
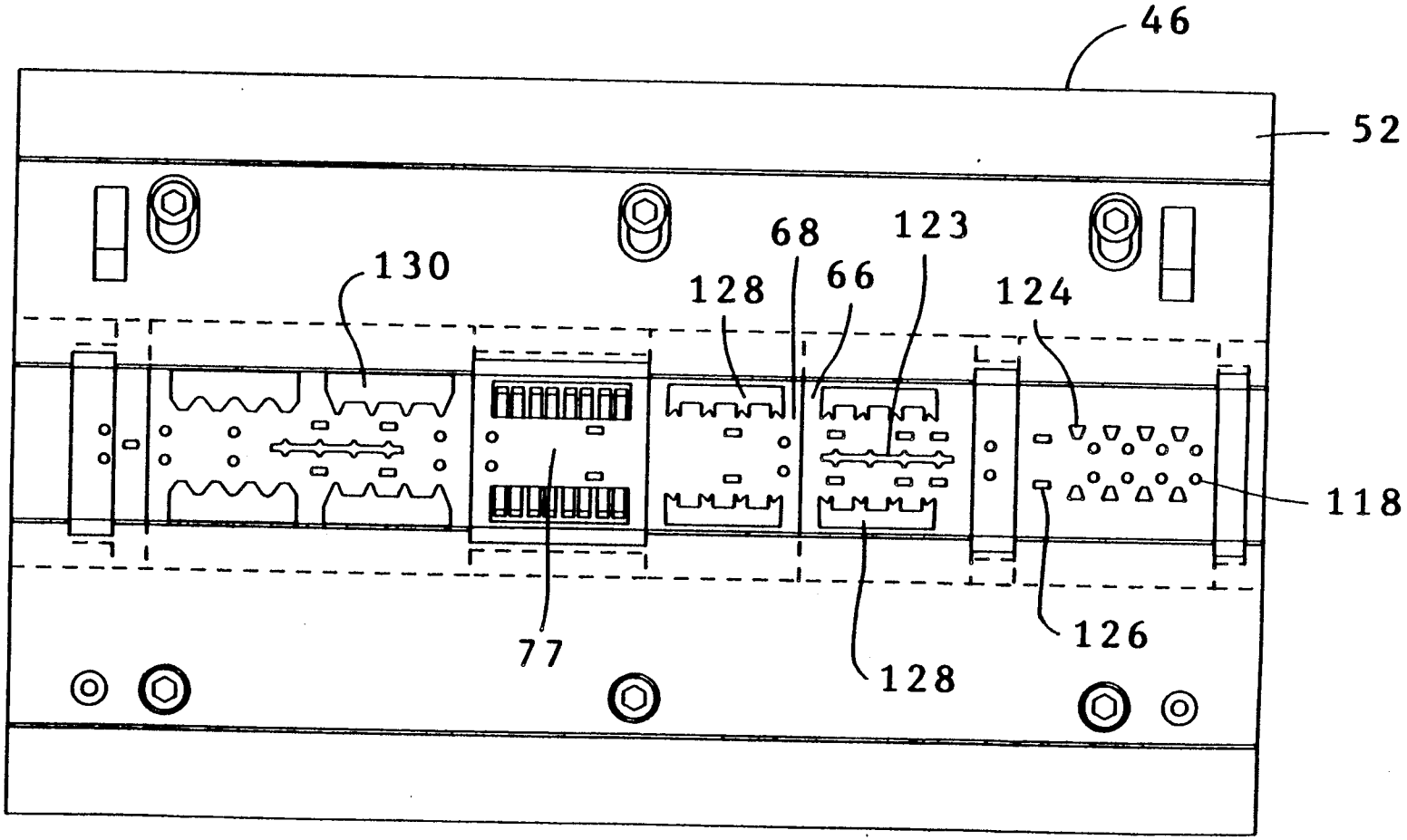
FIG. 7 is a view looking in the direction of the arrows 7—7 of FIG. 6.

FIGS. 1-3 illustrate the essential features of the invention and will be described prior to the description of a specific embodiment which is shown in FIGS. 4-8.

A conventional punch and die set comprises a die assembly 2 and a punch assembly 4. The punch and die assemblies are movable towards and away from each other so that when strip material 6 is positioned between the punch and the die, a hole will be punched in the strip. The die assembly 2 comprises a die plate 7 having a facial surface 8 and having a square recess 10 in the facial surface of the die plate. The recess has a recess surface 12 which is parallel to the facial surface 8 and the insert 14 has an obverse surface 16 and a reverse surface 18. The reverse surface 18 is against the recess surface 12 and the obverse surface 16 is coplanar with the facial surface 8. The insert has an insert opening 20 which extends therethrough to an enlarged opening 22 that extends through the die plate 7 and through the die backup block or spacer 9 as shown in FIG. 3. The punch 28 which extends from the face 30 of the punch assembly is dimensioned to enter the insert opening 20 and punch a hole in the strip. The insert is retained in the insert opening by retaining plates 24, 26 which overlap marginal side portions of the insert and the opening. Recesses 32 are provided in the facial surface 30 of the punch assembly to provide clearance for the retaining plates 24, 26.

When the punch and die set are placed in service, the edges of the opening 20 will, with the passage of time, become worn and the holes produced in the strip 6 will be lacking in dimensional precision. When the performance of the insert becomes unacceptable, it is merely necessary to remove the insert from the recess, and reverse the insert in the recess so that the original reverse surface 18 becomes the obverse surface and the original obverse surface 16 becomes the reverse surface.

In order to permit reversal of the insert in the die assembly, the opening 20 must extend normally of both of the surfaces 16, 18 so that the dimensions of the opening will be the same on both of the surfaces and the punched holes will be of the same dimensions regardless of which surface, 16 or 18, of the insert is serving as the obverse surface. As will be explained more fully below, the insert 14 is relatively thin, as compared with conventional inserts used in present practice, so that the punch will push the slug produced when the hole is punched in the strip into the enlarged portion 22 of the passageway which extends from the outlet side of the insert 14.

Reversibility of the insert also requires that the insert have at least one axis of symmetry which extends parallel to the surfaces 16, 18. In addition, the insert must, as viewed in cross-section (FIG. 2), be symmetrical with respect to a plane which is parallel to, and mid-way between, the surfaces 16, 18. The latter requirement is most easily satisfied if the edge surfaces 17 of the insert, which extend between the surfaces 16, 18 extend normally of the surfaces 16, 18. However, alternative edge surface configurations could be used; for example, a tongue and groove configuration on two opposite edge surfaces of the insert and side surfaces of the recess 10.

Figure 8:
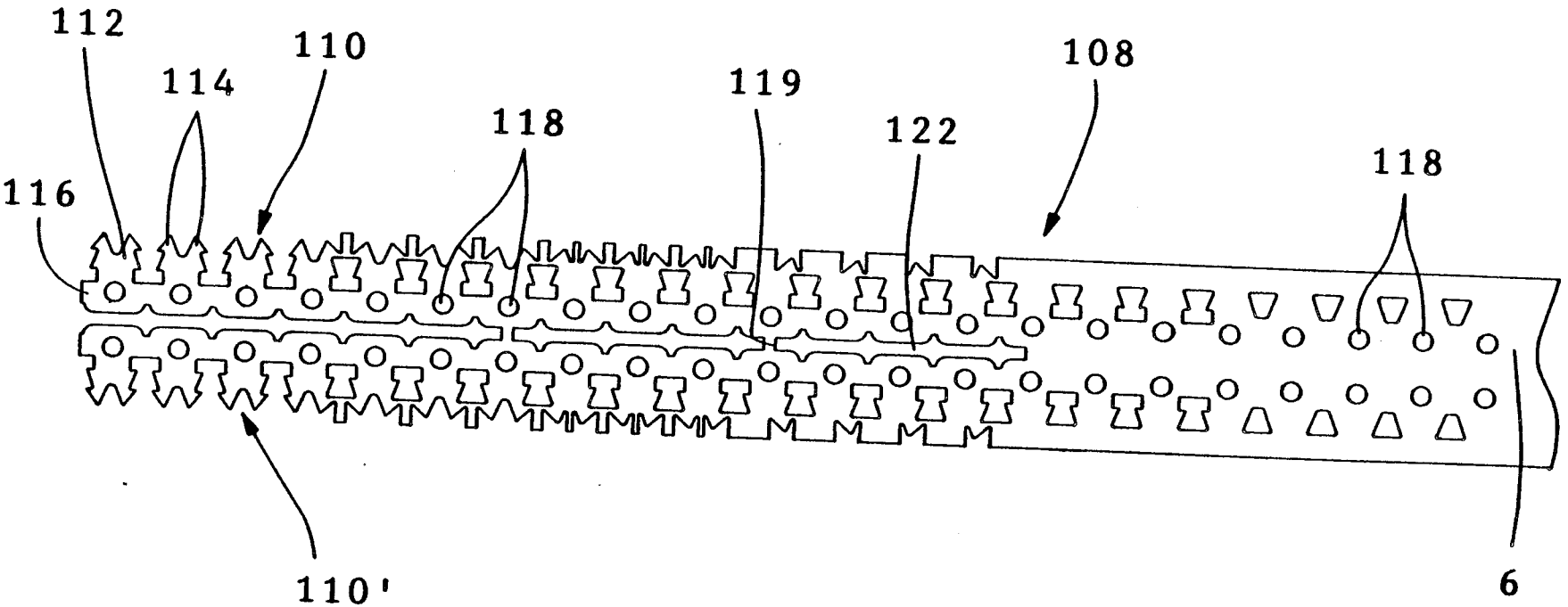
FIG. 8 is a plan view of a strip progression which is produced by the die set shown in FIG. 6.

FIGS. 4-7 show an actual die assembly 36 which is used with a punch assembly 34 to produce a progression 108, FIG. 8, from strip material 6. The progression shows the punching steps which are carried out on the strip material 6 to produce two side-by-side strips 110, 110', of individual terminals 112 which are connected to each other end-to-end. The terminals are flat stamped parts having two insulation piercing lances 114 which extend from a base portion 116. Each terminal has a pilot hole 118 which was punched in the strip in the first of the several punching stations illustrated by the progression. The two side-by-side terminal strips are formed when an elongated opening 122 is punched in the strip material 6 but the two strips remain connected to each other by short connecting neck sections 119 which are removed in the final punching operation carried out on the strip.

The punch and die assemblies 34, 36 are intended for use in a stamping and forming machine of the type described in U.S. Pat. No. 4,497,196. Detailed descriptions of the punch and die assemblies are presented in U.S. Pat. Nos. 4,819,476, and 4,809,576. The punch and die assemblies will, therefore, be described only to the extent necessary for an understanding of the present invention and reference is made to the above-identified U.S. Patents for further details on their construction and operation.

The punch and die assemblies 34, 36 are contained in a housing formed by top and bottom housing plates 38, 40 and side plates which extend between the top and bottom plates. The housing plates define a passageway 42 having a rectangular cross-section in which the punch and die assemblies are contained. The strip material is fed between the opposed surfaces of the punch and die assemblies through an opening 44 in the rear side plate as viewed in FIG. 6.

Die assembly 36 comprises a die plate 46 which is secured to a spacer or backup block 48 which in turn is secured to a reciprocable ram block (not shown). The ram block for the die assembly and the ram block for the punch are reciprocated towards and away from each other by the actuating mechanism of the machine as described in U.S. Pat. No. 4,497,196.

The die plate 46 has a facial surface 52 having opposite ends 54, 56 and the insert receiving recess 58 extends continuously between these two ends. The recess 58 has a recess surface 60 which is parallel to the facial surface 52 and recess side surfaces 62 which extend normally of the facial surface and the recess surface. The individual die inserts are positioned in the recess 58 and shown at 64, 66, 68, 70, and 72. In the disclosed embodiment, spacers 74, 76, 77, and 78, which function as positioning members, are provided, the spacers 74, 78 being at the ends of the stack of inserts and adjacent to the ends of the die plate and the spacer 76 and 77 being located between the inserts 64 and 66 and between inserts 68 and 70 respectively.

The inserts and the spacers are retained in the recess 58 by retaining plates 80, 82 which are secured to the facial surface of the die plate. The retaining plate 80 is precisely positioned on the die plate by locating pins 84, which extend from the die plate 46, and precisely located holes 85 in the plate 80. Plate 80 is permanently secured in a fixed position by fasteners 86. This retaining plate overlaps the inserts and the recess as shown at 88. The retaining plate 82 is secured to the die plate by fasteners 89 which extend through slots 90 so that it can be moved from its position shown in the drawing upwardly, as viewed in the drawing, to permit removal of the spacers and the die inserts. The position of the plate 82 on the die plate is precisely located by means of rectangular guide pins 94 which extend through rectangular openings 92 in the retaining plate. When the plate 82 is in its retaining position, it overlaps the inserts, the spacers, and the recess as shown at 96.

The inserts must be precisely located in the recess 58 so that the die openings will be in precise alignment with the punches in the punch assembly. Such precise location of the inserts is achieved by the side surfaces 62 of the insert receiving recess 58 and by the spacers, the side surfaces 62 serving to position the individual inserts in a vertical sense as viewed in FIG. 7 and the spacers serving to precisely locate the inserts in a horizontal sense. The spacers 74, 76, 77, and 78 are precisely located by means of notches 98, 100, 101, 102 which extend inwardly from the edge 104 of plate 82 and from the edge 105 of plate 80. These notches receive ears 106 which are integral with, and extend from, the positioning spacers.

The shapes and locations of the individual punches contained in the punch assembly 34 will be apparent from an inspection of the die openings coupled with an inspection of the progression 108. The pilot pin holes 118 are first punched in the strip in the insert 64. Also, the insert 64 has trapezoid-shaped openings 124 formed therein and rectangular openings 126. The inserts 66 and 68 contain die openings 128 for punching an elongated opening 122 and carrying out punching operations which result in formation of the insulation-piercing lances. Additional rectangular openings are also produced in the inserts 66, 68. The spacer 77 has rectangular openings therein through which swaging tooling projects. The swaging tooling is mounted on the die plate in the conventional manner by means of a laterally extending foot as described above. The final operations are carried out by the die openings and the cooperating punches in the insert 70 and in the end insert 72. Die openings are provided for sharing punches in insert 70 and the connecting neck section 119 which extend between the two strips 110, 110' is removed by insert 72.

The punch assembly may be as generally described in the U.S. Patents discussed above. Recesses 32 are provided in the facial surface of the punch assembly which receive the retaining plates 80, 82 when the punch and die assemblies are against each other.

The actual locations of all the openings in the die inserts will be dictated by considerations of die design; for example, rectangular openings 126 are provided in the inserts 64 and 66 so that the punches which form these openings in the strip will not be extremely close to each other. Pilot holes 118 are formed as soon as the strip moves between the punch and die assemblies in the insert 64 since these openings are essential for positioning the strip in subsequent operations. It should be noted that pilot holes are provided in the spacers 76 and 78 in order precisely to locate the strip in the adjacent inserts. The lengths of the inserts, as viewed in the direction of strip feed, varies as shown by the drawing and again will be dictated by considerations of die design. For example, the insert 70 is relatively long while the insert 72 is extremely narrow and has only one die opening therein. The insert 72 is purposefully made extremely short for the reason that the punch which enters the die opening in the insert 72 is subject to heavy wear and high stresses and is more likely to fail in service than some of the other punches. If failure of the punch with resulting damage to the die insert 72 does take place, it is only necessary to replace this relatively small insert having one die opening therein.

The individual inserts are assembled to the die plate as follows. The retaining plate 82 is first moved to its retracted position by loosening the fasteners which extend through the slots 90 and moving the retaining plate 82 away from the insert receiving recess. Spacer 77 is positioned in recess 58 and inserts 70, 72, 68, and 66 are then positioned in the recess. Thereafter, spacers 78 and 76 are placed in the recess with their ears 106 in the appropriate notches 102 and 100. Insert 64 is then placed in recess 58 and end spacer 74 is placed against the side of the insert 64. The inserts are assembled to the die plate by sliding them into the recess from one of the ends. The retaining plate 82 is then moved to the position shown in FIG. 5 and the fasteners 90 are tightened securely to retain the plate in its position. The die assembly can then be placed in service to produce, in cooperation with the punch assembly, strip 108 as shown in the drawing.

When the dimensional precision of the terminals produced begins to deteriorate because of wear of the die inserts, all of the inserts shown can be reversed by simply loosening the fasteners 90, moving the retaining plate 82 to its retracted position. The dimensions of the spacers are such that they can then be removed from the recess 58 when plate 82 is in its retracted position so that the inserts can be removed by sliding them rightwardly or leftwardly as viewed in the drawing from the die plate. The inserts can then be reversed as explained above so that the obverse surface of each insert becomes the reverse surface and the fresh reverse surface becomes the obverse surface. This operation of reversing the inserts can be carried out rapidly and does not require the services of a skilled machinist as does a conventional die sharpening operation.

All of the die openings in the die inserts must extend normally of the obverse and reverse surfaces of the insert so that the dimension of each opening is the same on both surfaces. This requirement of die inserts in accordance with the present invention departs from ordinary die insert design practice in that it is customary in the design of conventional die inserts to provide a slight taper in the die opening so that the slugs which are punched from the strip will move through the die opening and not become jammed therein. The necessity for providing tapered openings in the die inserts is eliminated in the practice of the present invention by virtue of the fact that the die inserts are relatively much thinner than conventional die inserts. For example, a tool steel insert, in accordance with the present invention, need have a thickness of only about 0.062 inches (1.57 mm) while a carbide insert can have a thickness of only about 0.10 inches (2.54 mm). By contrast, it is common practice to provide conventional die inserts having a thickness of 0.5 inches (12.7 mm) or more. Because of the fact that the die inserts are relatively thin, the punches in the punch assembly move entirely through the die openings in the die inserts, or substantially therethrough in the case of carbide inserts, so that the slugs will be moved from the die inserts and into the relatively enlarged openings in the die plate from which they can be removed by conventional means without jamming of the slugs in these openings The insert retaining system described above can be used with conventional inserts as well as the reversible inserts of the present invention. The reversible insert system can on the other hand be used in die assemblies having a simplified insert mounting and retaining system (as compared with the system described).

While separate die plates 7 and 46 are shown in the drawing, it will be apparent that the die plate can be eliminated, if it is desired to do so, and the insert receiving recess provided in the spacer or back-up block 48.

I claim:

1. A die assembly having a facial surface, a recess in the facial surface and die insert means in the recess, the die assembly being characterized in that:

the recess extends entirely across the facial surface from a first end thereof to a second end, the insert means comprises a plurality of inserts in side-by-side relationship between the ends of the recess, a pair of parallel spaced apart retaining plates are provided on the facial surface which extend parallel to, and which overhang, the recess, one of the retaining plates being movable parallel to, and on, the facial surface between a retaining position and a retracted position, at least two spacers are provided in the recess for locating the inserts, the spacers and the one retaining plate having interengaging portions which precisely locate the spacers in the recess, the interengaging portions being effective to retain the spacers in the recess when the one plate is in its retaining position, the spacers being removable from the recess when the one plate is in its retracted position, the inserts being removable from the recess after removal of the spacers by sliding the inserts past one of the ends of the recess.

2. A die assembly in combination with a stamping and forming machine, the machine having a punch assembly which is movable relatively towards and away from the die assembly and strip feeding means for feeding strip material along a strip feed path which extends between the die assembly and the punch assembly, the die assembly having at least one die opening therein which receives a punch extending from the punch assembly when the punch assembly moves relatively towards the die assembly thereby to punch an opening in the strip material, the die assembly comprising:

a die plate having a facial surface which is opposed to the punch assembly, the die plate having first and second spaced-apart ends, a recess extending from the first end at least partially towards the second end, the recess having a recess inner surface which is parallel to the facial surface and parallel recess side surfaces and normally of the recess inner surface, at least one rectangular die insert in the recess, the die insert having an obverse surface, a reverse surface, and first and second opposed pairs of insert side surfaces which extend between, and normally of, the obverse and reverse surfaces, the first pair of insert side surfaces being against the recess side surfaces, the second pair of insert side surfaces extending normally of the recess side surfaces and laterally across the recess, the insert being positioned in the recess with the reverse surface against the recess inner surface, a first insert retaining plate mounted on the facial surface, the first retaining plate extending parallel to, and beside, one side of the recess, the first retaining plate being movable laterally of the recess between a retaining position and a retracted position, at least one spacer removable contained in the recess for locating precisely the die insert in the recess, first interengaging means on the first retaining plate and on the spacer which are interengaged when the first retaining plate is in its retaining position, the first interengaging means being effective precisely to locate the spacer in the recess whereby the die insert is precisely located in the recess, the die opening being untapered and having an axis of symmetry which permits reversal of the insert so that the reverse surface becomes the obverse surface and the obverse surface becomes the reverse surface.

3. A die assembly as set forth in claim 2 characterized in that the recess extends entirely across the die plate from the first end to the second end, and a plurality of die inserts and spacers are provided in the recess.

4. A die assembly as set forth in claim 2 characterized in that the first interengaging means comprises notches and ears.

5. A die assembly as set forth in claim 2 characterized in that a second insert retaining plate is provided on the facial surface, the second retaining plate being secured to the facial surface and extending along the other side of the recess and having portions which overhang the recess.

6. A die assembly as set forth in claim 5 characterized in that second interengaging means are provided on the second retaining plate and on the spacer.

7. A die assembly as set forth in claim 2 characterized in that interfitting guide means are provided on the first retaining plate and on the facial surface for guiding the first retaining plate during movement and for locating the first retaining plate precisely in its retaining position, and clamping means are provided for clamping the retaining plate in its retaining position.

8. A die assembly as set forth in claim 1 characterized in that the interfitting guide means comprises slots in the first retaining plate and guide pins in the facial surface, the clamping means comprising clamping screws.

9. A die assembly as set forth in claim 2 characterized in that the recess extends entirely across the die plate from the first end to the second end, a plurality of die insert and spacers are provided in the recess, the first interengaging means comprises notches and ears, interfitting guide means are provided on the first retaining plate and on the facial surface for guiding the first retaining plate during movement and for locating the first retaining plate precisely in its retaining position, and clamping means are provided for clamping the first retaining plate in its retaining position.

10. A die assembly as set forth in claim 9 characterized in that a second insert retaining plate is provided on the facial surface, the second retaining plate being secured tot he facial surface and extending along the other side of the recess and having portions which overhang the recess, and the interfitting guide means comprising slots in the retaining plate and guide pins in the facial surface, the clamping means comprising clamping screws.

11. A die assembly as set forth in claim 10 characterized in that second interengaging means comprising notches and ears are provided on the spacers and on the second guide plates.

12. A die assembly as set forth in claim 2 characterized in that the die insert is of tool steel and has a thickness of about 1.6 mm.

13. A die assembly as set forth in claim 2 characterized in that the die insert is of a carbide material and has a thickness of about 2.5 mm.

* * * * *

UNITED STATES PATENT OFFICE
CERTIFICATE OF CORRECTION

Patent No. 4,995,289 Dated February 26, 1991

Inventor(s) Johannes C.W. Bakermans

It is certified that error appears in the above-identified patent and that said Letters Patent is hereby corrected as shown below:

In claim 2, column 8, line 16 , after the word "surfaces" add --which extend normally of the facial surface--.

In claim 8, column 9, line 3, "claim 1" should be -- claim 7--.

In claim 10, column 10, line 2, the words "tot he" should be --to the--.

Signed and Sealed this

Twenty-ninth Day of September, 1992

*Attest:*

DOUGLAS B. COMER

*Attesting Officer*

*Acting Commissioner of Patents and Trademarks*